US009510692B2

(12) United States Patent
Huljev

(10) Patent No.: US 9,510,692 B2
(45) Date of Patent: Dec. 6, 2016

(54) BUCKWHEAT NURSING AID AND BABY SUPPORT PILLOW

(71) Applicant: Tasha Kali Huljev, Fresno, CA (US)

(72) Inventor: Tasha Kali Huljev, Fresno, CA (US)

(73) Assignee: Tasha Kali Huljev, Fresno, CA (US)

( * ) Notice: Subject to any disclaimer, the term of this patent is extended or adjusted under 35 U.S.C. 154(b) by 0 days.

(21) Appl. No.: 14/460,739

(22) Filed: Aug. 15, 2014

(65) Prior Publication Data

US 2016/0045036 A1 Feb. 18, 2016

(51) Int. Cl.

| | |
|---|---|
| ***A47D 13/08*** | (2006.01) |
| ***A47C 20/02*** | (2006.01) |
| ***A47D 15/00*** | (2006.01) |

(52) U.S. Cl.

CPC ..... *A47D 13/083* (2013.01); *A47C 20/02* (2013.01); *A47D 15/008* (2013.01)

(58) Field of Classification Search

CPC .... A47C 16/00; A47C 20/02; A47C 20/025; A47C 20/026; A47D 13/00; A47D 13/08; A47D 13/083; A47D 15/00; A47D 15/005; A47D 15/006; A47D 15/008; A47G 9/10; A47G 9/1045; A47G 9/1072; A47G 9/1081; A47G 9/109

See application file for complete search history.

(56) References Cited

U.S. PATENT DOCUMENTS

| | | | | |
|---|---|---|---|---|
| 3,327,330 | A * | 6/1967 | McCullough | 5/640 |
| 4,731,890 | A * | 3/1988 | Roberts | 5/655 |
| 5,261,134 | A * | 11/1993 | Matthews | 5/655 |
| 5,519,906 | A * | 5/1996 | Fanto-Chan | 5/631 |
| 6,052,848 | A * | 4/2000 | Kelly | 5/632 |
| 6,279,185 | B1 * | 8/2001 | Matthews | 5/655 |
| 6,453,493 | B1 * | 9/2002 | Matthews Brown | 5/636 |
| 6,499,164 | B1 * | 12/2002 | Leach | 5/632 |
| 6,658,681 | B2 * | 12/2003 | Britto et al. | 5/655 |
| 6,944,898 | B2 * | 9/2005 | Matthews Brown et al. | 5/655 |
| 7,000,273 | B2 * | 2/2006 | Rivera-Wienhold et al. | 5/632 |
| 7,010,821 | B1 * | 3/2006 | Leach | 5/655 |
| 7,322,061 | B2 * | 1/2008 | Carroll | 5/630 |
| 7,472,443 | B2 * | 1/2009 | Littlehorn et al. | 5/632 |
| 7,562,406 | B1 * | 7/2009 | Leach | 5/655 |
| 7,587,773 | B2 * | 9/2009 | Littlehorn et al. | 5/655 |
| 7,657,955 | B1 * | 2/2010 | Alvistur et al. | 5/655 |
| 7,676,871 | B1 * | 3/2010 | Leach | 5/655 |
| 7,793,371 | B1 * | 9/2010 | Leach | 5/632 |
| 7,886,381 | B2 * | 2/2011 | Aiken et al. | 5/632 |
| 7,900,303 | B2 * | 3/2011 | Mastrosimone-Gese | 5/655 |
| 7,975,336 | B1 * | 7/2011 | Perry | A47C 20/027 5/636 |
| 8,365,329 | B1 * | 2/2013 | Barsosky | 5/655 |
| 8,468,627 | B2 * | 6/2013 | Leach | 5/632 |
| 8,595,872 | B2 * | 12/2013 | Tidwell | 5/655 |
| 8,661,587 | B1 * | 3/2014 | Leach | 5/655 |
| 9,021,635 | B1 * | 5/2015 | Leach | A47C 20/02 5/630 |
| 2007/0186346 | A1 * | 8/2007 | Jensen | 5/655 |
| 2009/0133193 | A1 * | 5/2009 | Weise | 5/640 |
| 2013/0232691 | A1 * | 9/2013 | Saul | 5/632 |

(Continued)

*Primary Examiner* — Nicholas Polito

(57) ABSTRACT

The main purpose of the pillow is for nursing mothers who want or need to lie down to breast feed their babies. Normally a mother will have to change sides when feeding a baby while lying down to allow the baby to nurse on both breasts. The mother must either reposition herself or move the baby. This pillow eliminates that problem allowing the mother and baby to comfortably stay in one place. The pillow is also very versatile in its configurations making it a multifunctional pillow with very little to be done by the user. The formable pillow having a buckwheat hull filling provides safe comfortable support for the mother and babies of all ages in many ways.

9 Claims, 15 Drawing Sheets

(56) References Cited

U.S. PATENT DOCUMENTS

2014/0215719 A1* 8/2014 Gibbons et al. ..... 5/632
2014/0359945 A1* 12/2014 Williams ..... 5/655
2015/0040323 A1* 2/2015 Staats ..... 5/640
2015/0101125 A1* 4/2015 Fang ..... 5/655
2015/0173524 A1* 6/2015 McQuilton ..... 5/652.1

* cited by examiner

18in
20in

12in
48in

BUCKWHEAT NURSING AID AND BABY SUPPORT PILLOW

BACKGROUND OF INVENTION

Prior to this pillow all nursing pillows were either made from polyester filling or a foam material, neither of which forms to your body shape or the babies and is harmful to the environment. Hence there is a need to make a pillow out of buckwheat that is segmented to cure the deficiency of the prior art. Buckwheat nursing pillow and baby support invented by Tasha Kali Huljev. The main purpose of the pillow is for nursing mothers of babies of all ages who want or need to lie down or recline to breast feed their babies without having to move or reposition either themselves or the baby. Ideal for mother's right after a Caesarean section or for use with co-sleepers. The formable pillow provides safe comfortable support for the mother and babies of all ages.

A search of related patents does not reveal an existing reclining buckwheat nursing pillow patent that consists of a single pillow that can easily be adapted with and without being snapped into 5 different shapes. The patents found are as follows:

| Suckling pillow | |
|---|---|
| Publication number | CN200963024 |
| Publication type | Grant |
| Application number | CN 200620015543 |
| Publication Date | Oct. 24, 2007 |
| Filing Date | Oct. 31, 2006 |
| Apparatus and method for feeding a child while lying down or sitting | |
| Publication number | WO2013120177 A1 |
| Publication type | Application |
| Application number | PCT/CA2013/000125 |
| Publication Date | Aug. 22, 2013 |
| Filing Date | Feb. 15, 2013 |
| Multifunction shaped pillow | |
| Publication number | CN202136065 U |
| Publication type | Grant |
| Application number | CN 201120175274 |
| Publication Date | Feb. 8, 2012 |
| Filing Date | May 27, 2011 |
| Protective pillow for neck and waist | |
| Publication number | CN200939001 Y |
| Publication type | Grant |
| Application number | CN 200620131355 |
| Publication Date | Aug. 29, 2007 |
| Filing Date | Aug. 29, 2006 |

BRIEF SUMMARY OF INVENTION

How to Use

When the baby is smaller the mother uses the pillow in the snapped configurations. As the baby grows the mother will primarily use the unsnapped positions.

For the nursing mother of a newborn or small infant the pillow is snapped and shaped into a rounded cone shape (FIG. 2). The infant is positioned at the wide end of the cone to be fed on the mother's upper breast. The baby is then slipped down toward the lower end of the cone to be fed on the lower breast. The baby can be left on his or her back on the pillow for resting (FIG. 1 O shape for infants, FIG. 9 oval shape for older babies).

As the baby grows the base of the snapped pillow can be widened into an oval shape by shortening the length of the pillow and pulling out the sides (FIG. 13). The baby's head will still be positioned at the wide end of the oval and the baby's body will be placed in the opening of the oval to be fed on the upper breast (FIG. 5). The baby is then lowered further into the opening for feeding on the lower breast.

If the mother has large breasts she can position the baby in the pointed cone or oval area and put her breast on the pillow's edge forming a ledge for her breast. This provides the baby a better latch position while feeding without the mother having to hold the breast (FIG. 5, FIG. 6).

Older infants will be nursed using the unsnapped U or horseshoe position (FIG. 3). The technique for feeding is the same. The baby's head will start further up on the middle of the horseshoe for feeding on the upper breast and will be slipped down for feeding on the lower breasts.

The unsnapped L position (FIG. 4) is used when nursing while seated on a couch or in a recliner. The first triangular side of the pillow is placed behind the mother's back for support. The middle of the pillow supports the mother's arm and baby's head. The other triangular side of the pillow is placed alongside baby's back (FIG. 8, FIG. 7). The L shape can also be used when nursing an older infant while lying down. The first triangular side of the pillow is placed under the mother's head and the long side of the pillow supports the baby's back while cuddling the infant to the mother (FIG. 16).

The L position is also used for toddlers as a body pillow. The pillow can be used with first triangular side of the pillow is placed under toddlers head and long side of the pillow along the toddler's body. Pillow helping the child get comfortable with out you, they can hug and rest their arms and legs on the pillow. This can allow them to stay asleep longer. (FIG. 19)

To use the pillow as a lumbar support when the baby is starting to sit up, you simply form the pillow around the baby's bottom/lumbar and thighs without limiting the baby's reach or mobility (FIG. 10). This shape mimics the support a baby receives when placed between a mother's thighs to help sit up.

The pillow and case are also made with the environment in mind using sustainable resources like bamboo and buckwheat

DETAILED FIGURE DESCRIPTION

Figure 11:
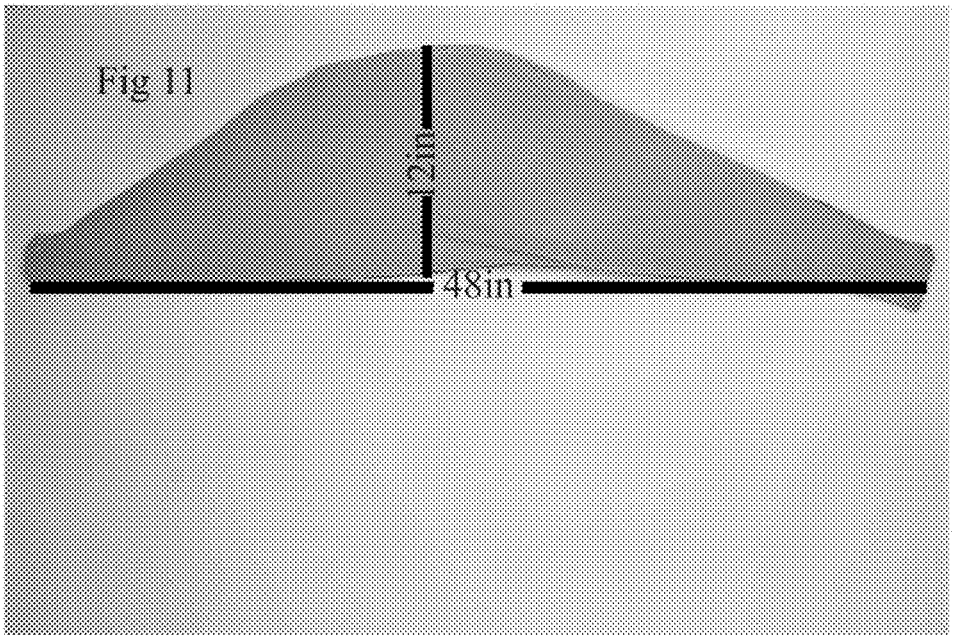
Figure 14:
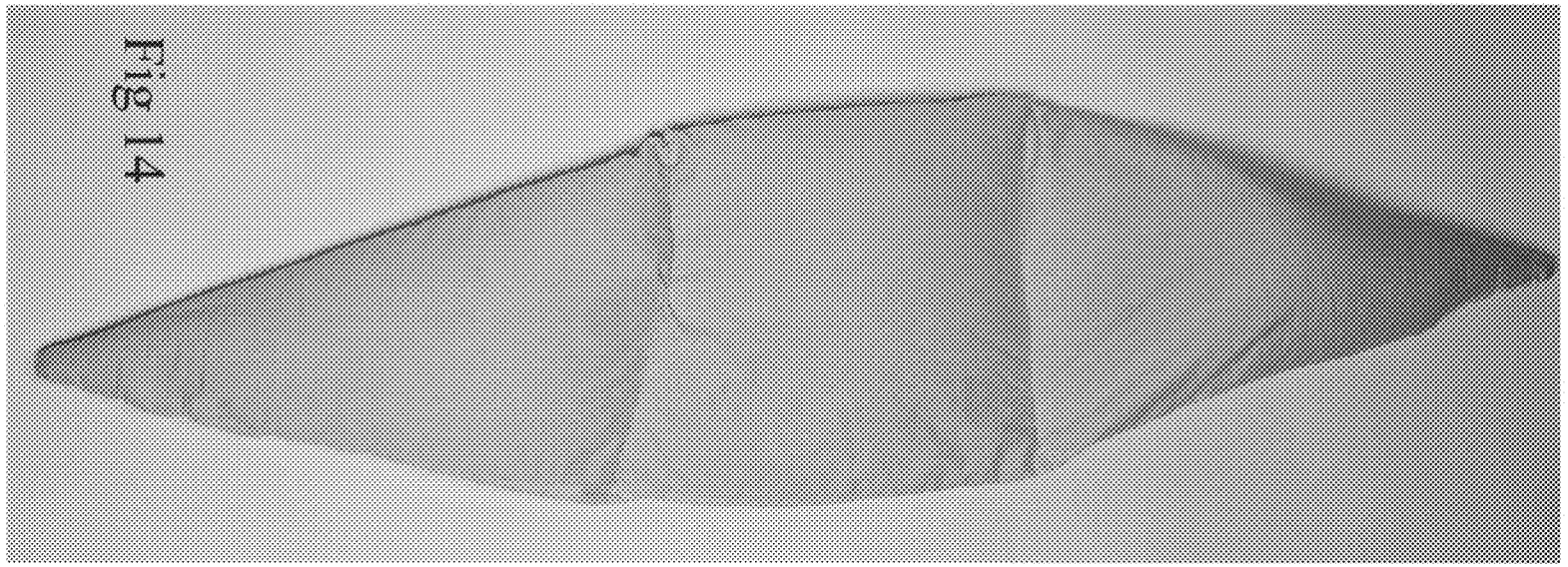
FIG. 14 Top view of inside pillow insert without the outside case shown divided into three parts; one substantial rectangle center and two triangular arms on either side.

The rounded triangular shaped pillow (FIG. 11) consists of two parts (FIG. 14). The first part is a single inner pillow that is filled with premium grade A triple cleaned and heat-treated buckwheat hulls. The buckwheat hulls are flattened during the cleaning process eliminating the noise typically associated with buckwheat filled pillows. The pillow is then divided into three sections resembling two triangles on either side of a rectangle (FIG. 14). The sections allow the buckwheat to move freely within a section without bunching up in one area of the pillow. The buckwheat filling also allows the pillow to conform to the baby and the mother's breast shape providing comfortable support to both mother and child.

Figure 1:
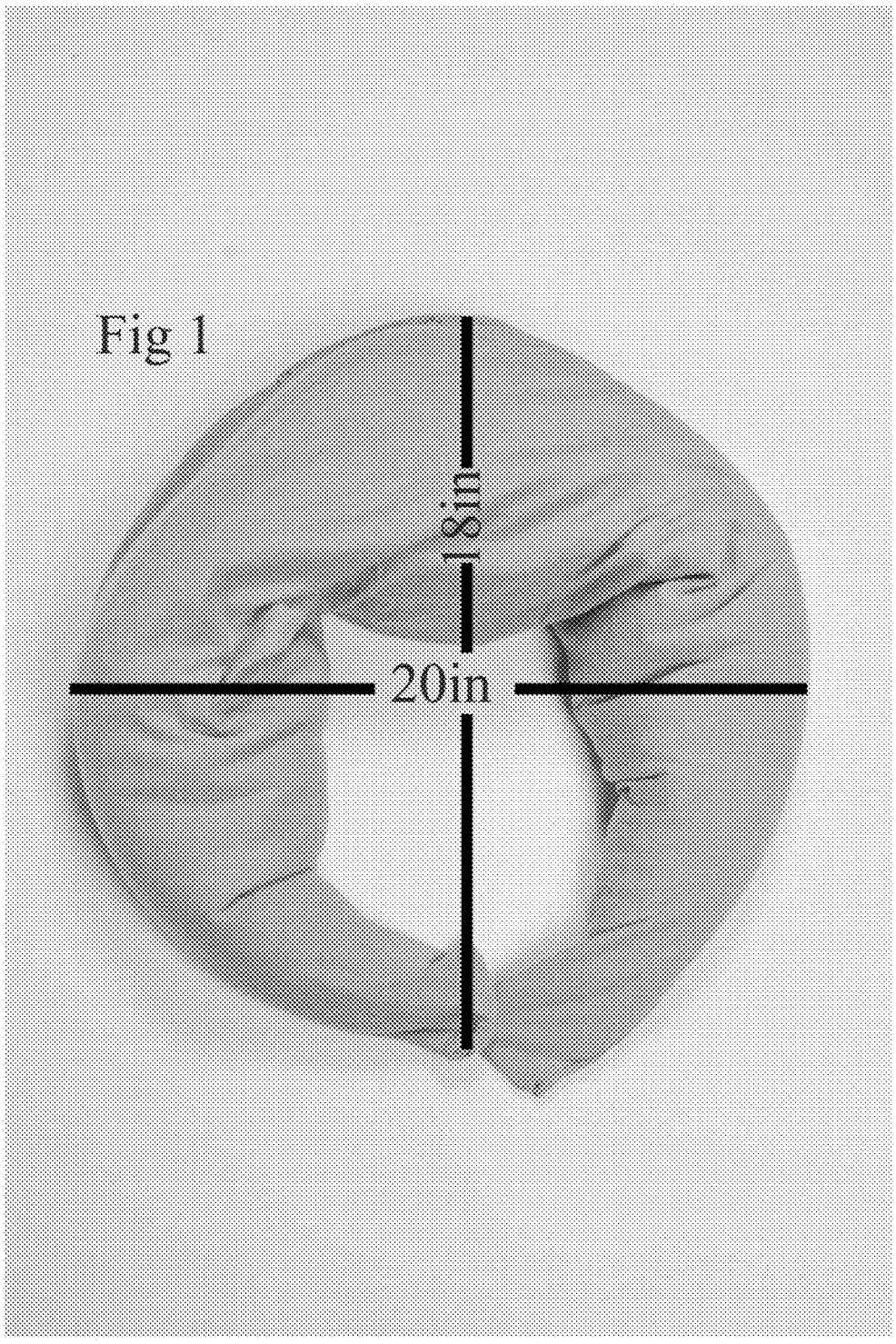
FIG. 1 Top view of the snapped pillow in the O shape measuring 18 inches tall and 20 inches wide FIG. 2 Top view of the snapped pillow in the cone shape measuring 20 inches tall, 12 inches wide at the top of the cone and 4 inches wide at the base of the cone shape FIG. 3 Top view of the pillow in the unsnapped narrower U or horseshoe shape measuring 23 inches tall and 18 inches wide at the base FIG. 4 Top view of the unsnapped pillow in the L position measuring 27 inches tall by 20 inches wide at its widest point FIG. 5 Top view of baby positioned for feeding on upper breast with pillow formed in the snapped oval shape FIG. 6 Top view of baby positioned for feeding on lower breast with pillow formed in the snapped cone shape FIG. 7 Front facing view of nursing baby with pillow in unsnapped L shaped position while reclining on a couch FIG. 8 Top view of nursing baby with pillow shaped in unsnapped L position while seated FIG. 9 Top view of baby supported on snapped pillow in oval shape position FIG. 10 Top view of baby with pillow in unsnapped wide U or horseshoe shaped position for lumbar support FIG. 11 Flattened view of pillow in case measuring 12 inches tall at widest point and 48 inches long FIG. 12 Top down view of unsnapped pillow shaped in the wide U or horseshoe position FIG. 13 Top view of snapped pillow shaped in oval position measuring 20 in at longest point and 15 in wide.
Figure 2:
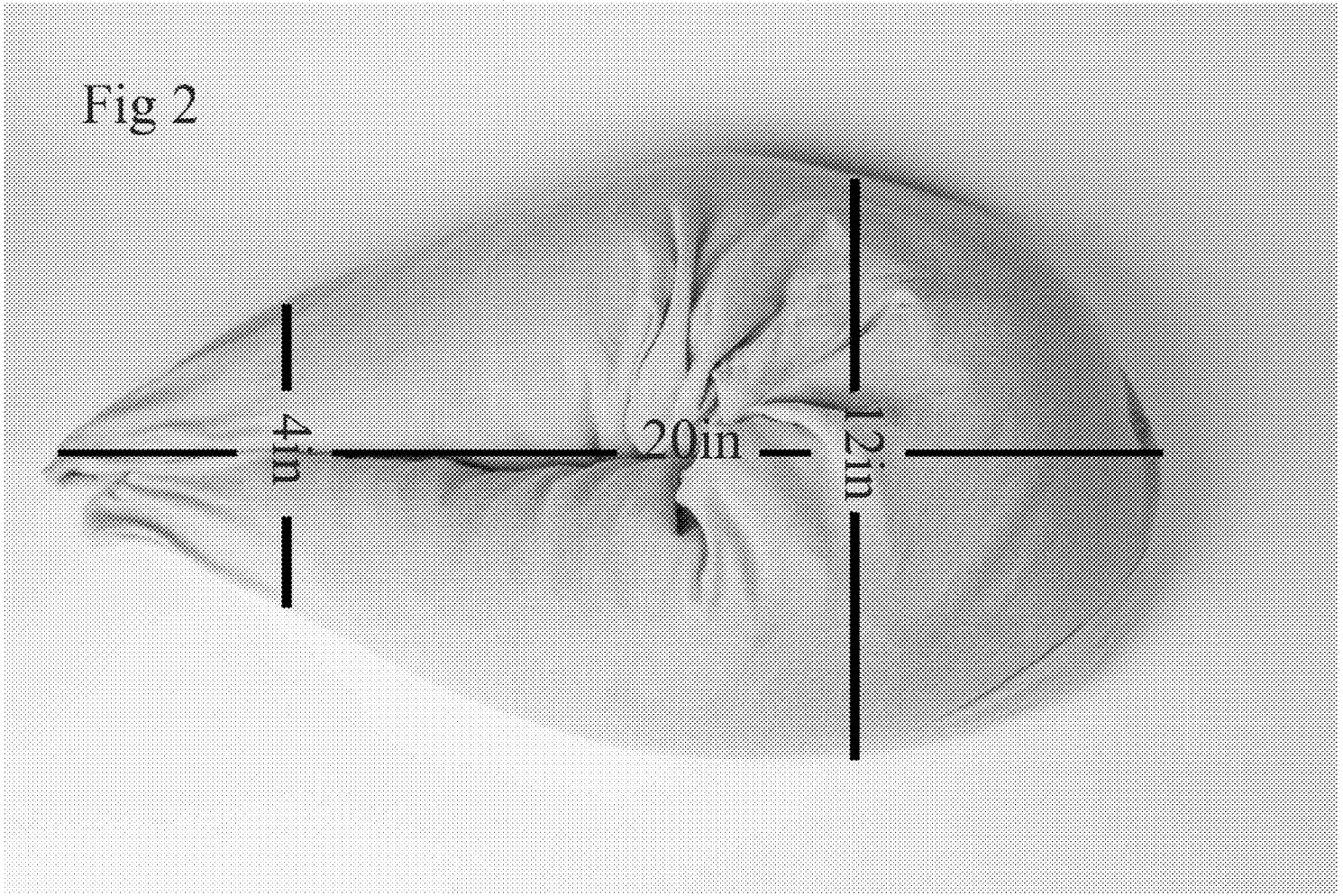
Figure 3:
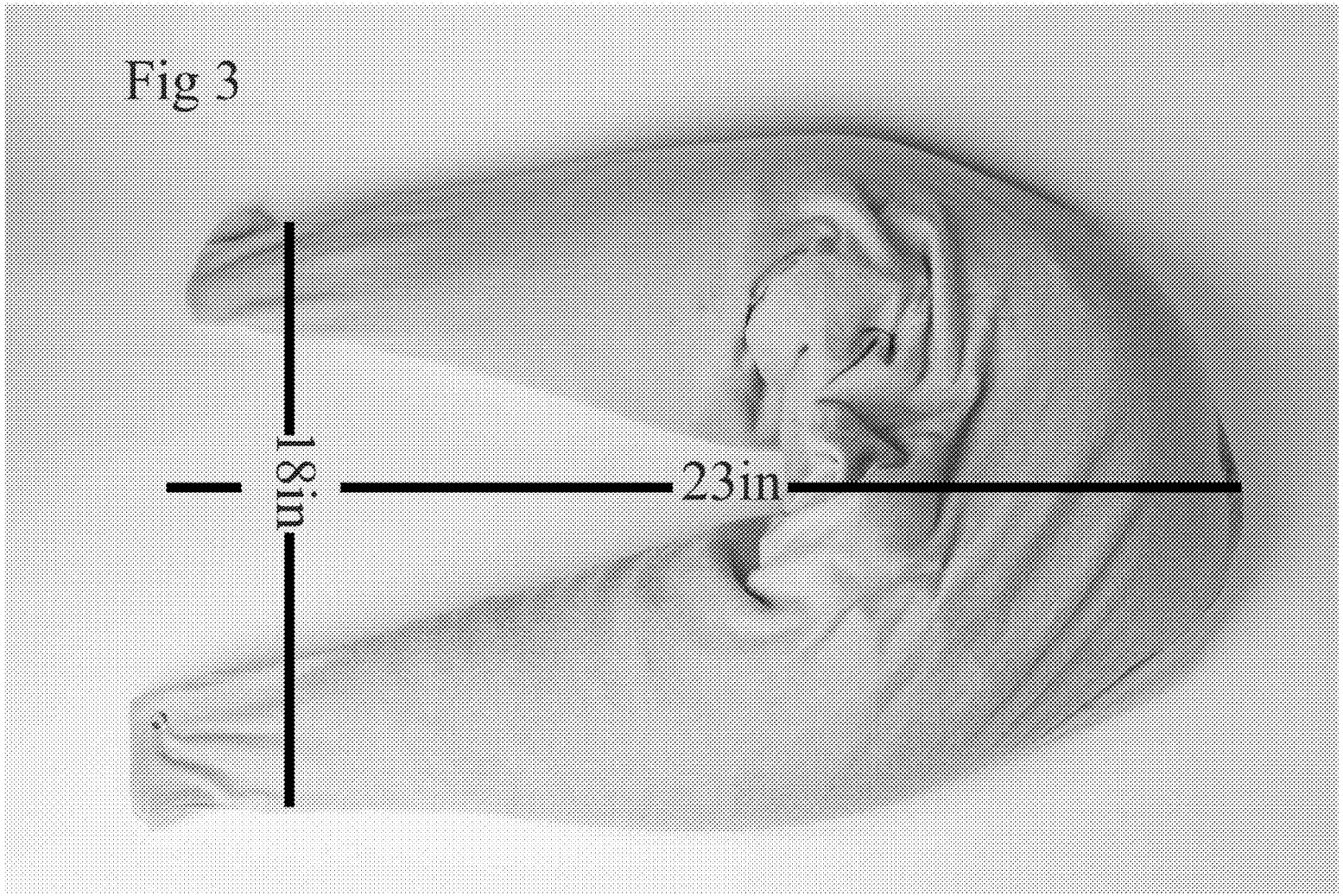
Figure 4:
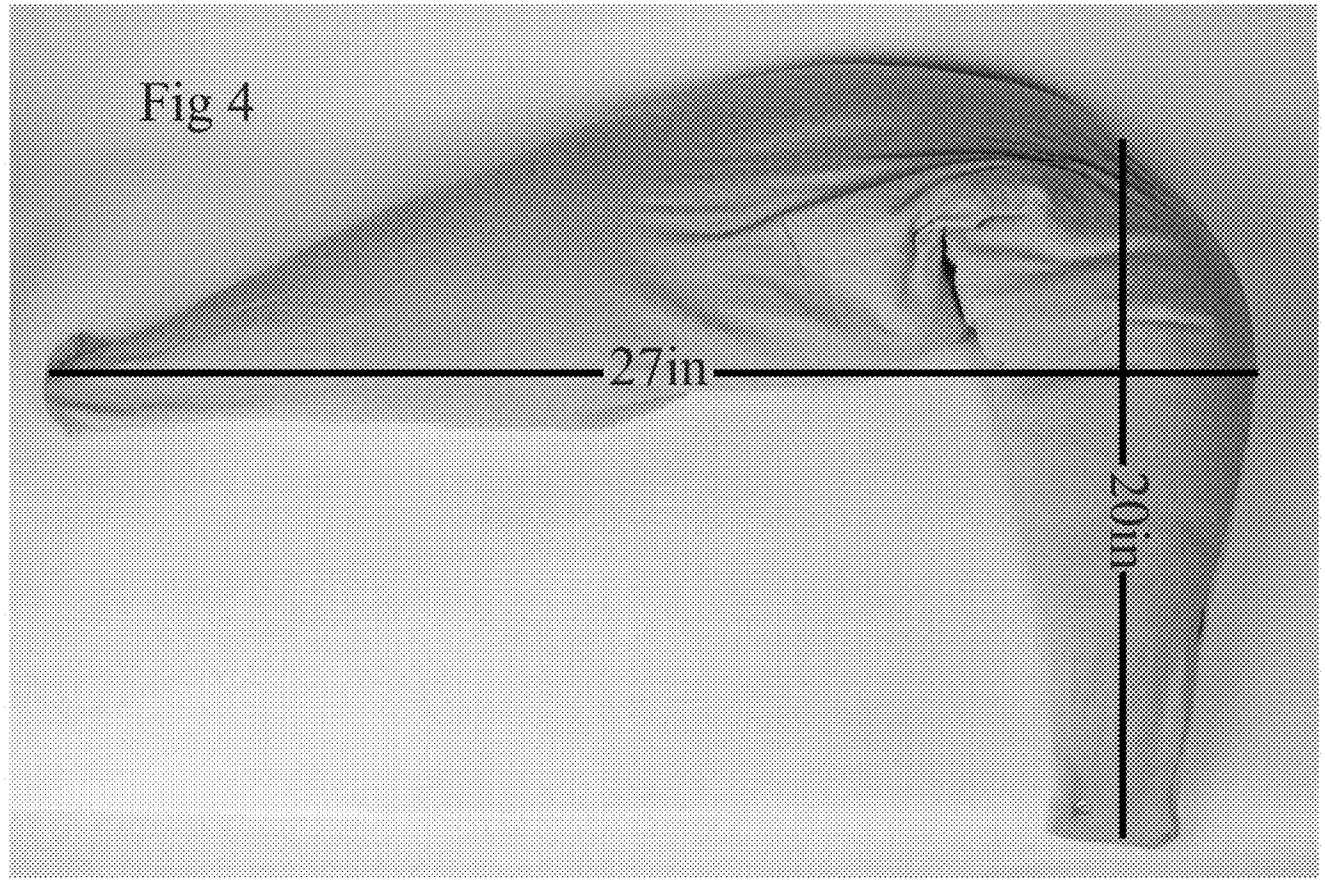
Figure 5:
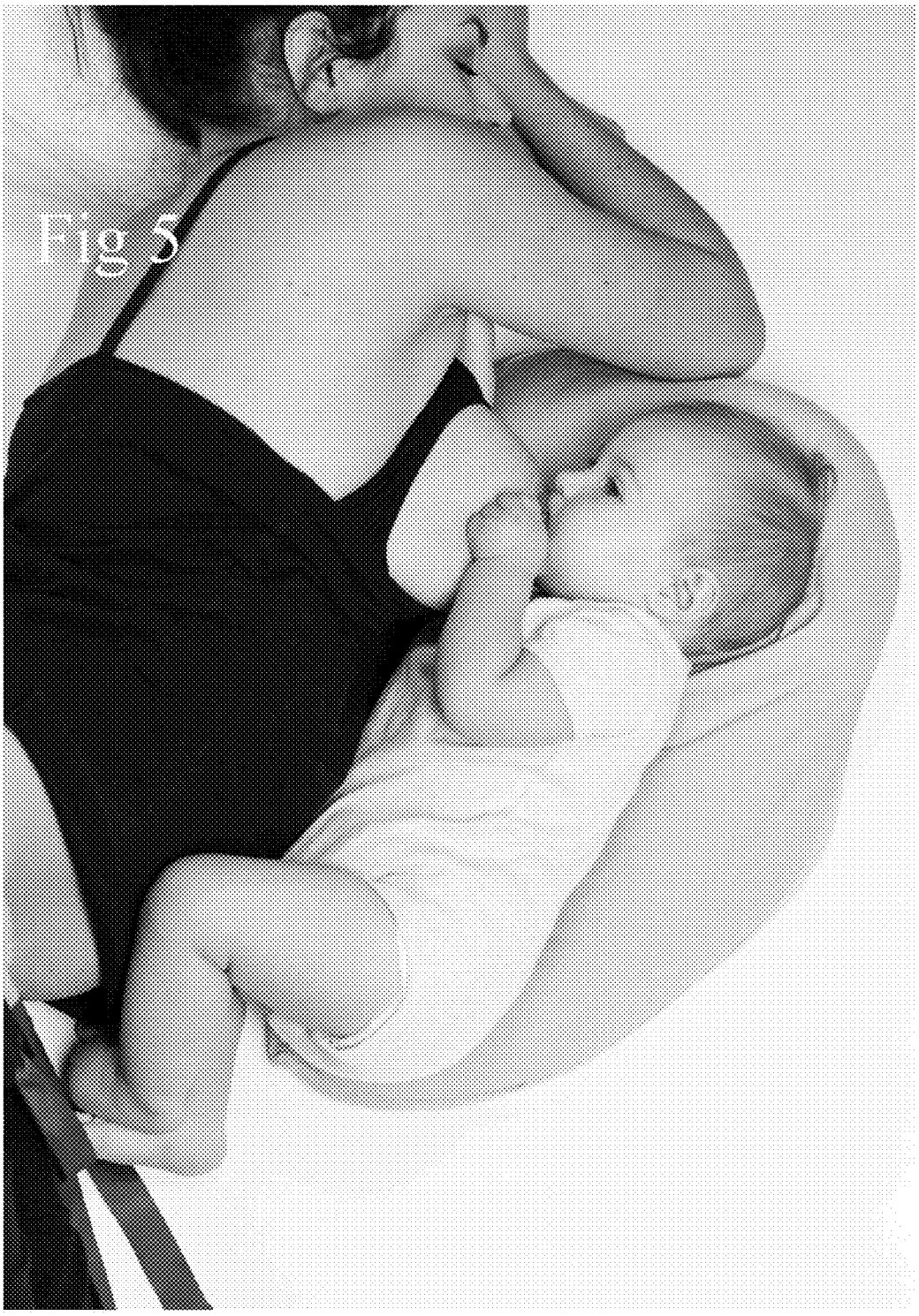
Figure 6:
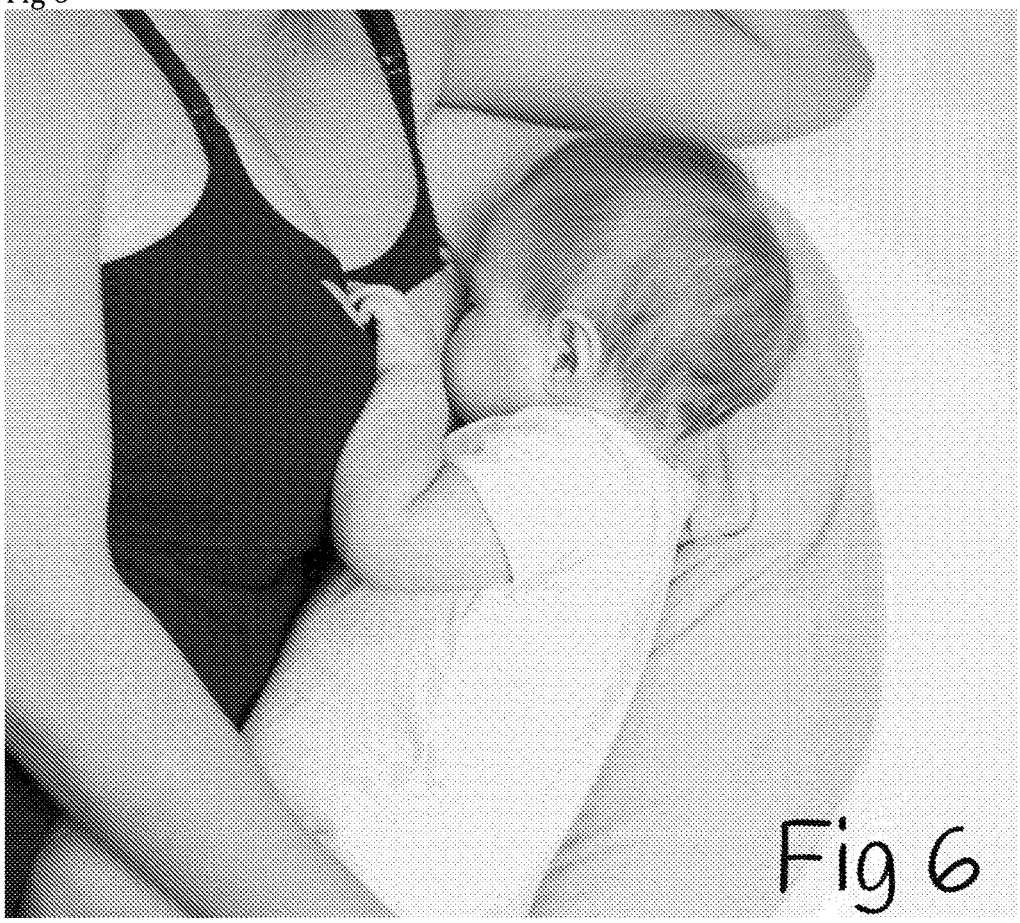
Figure 7:
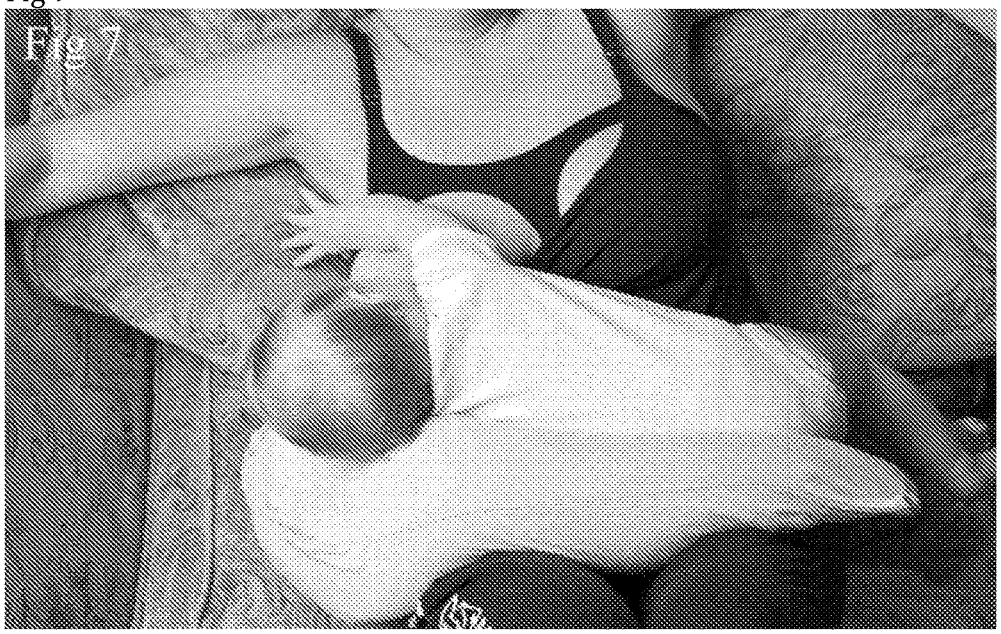
Figure 8:
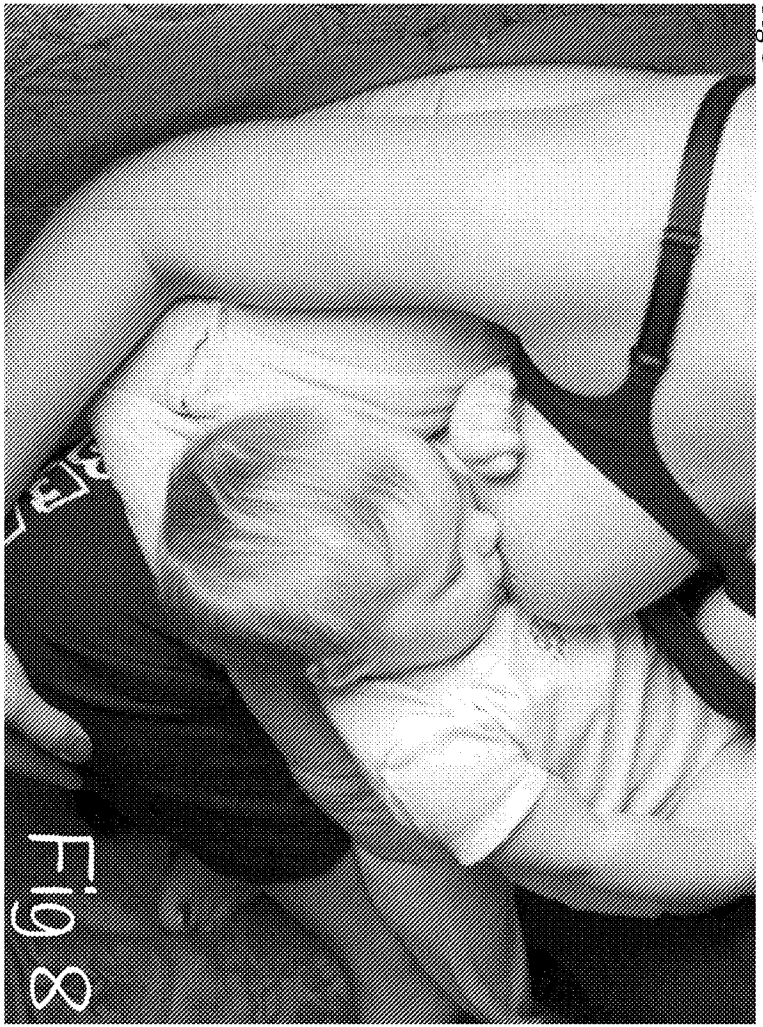
Figure 9:
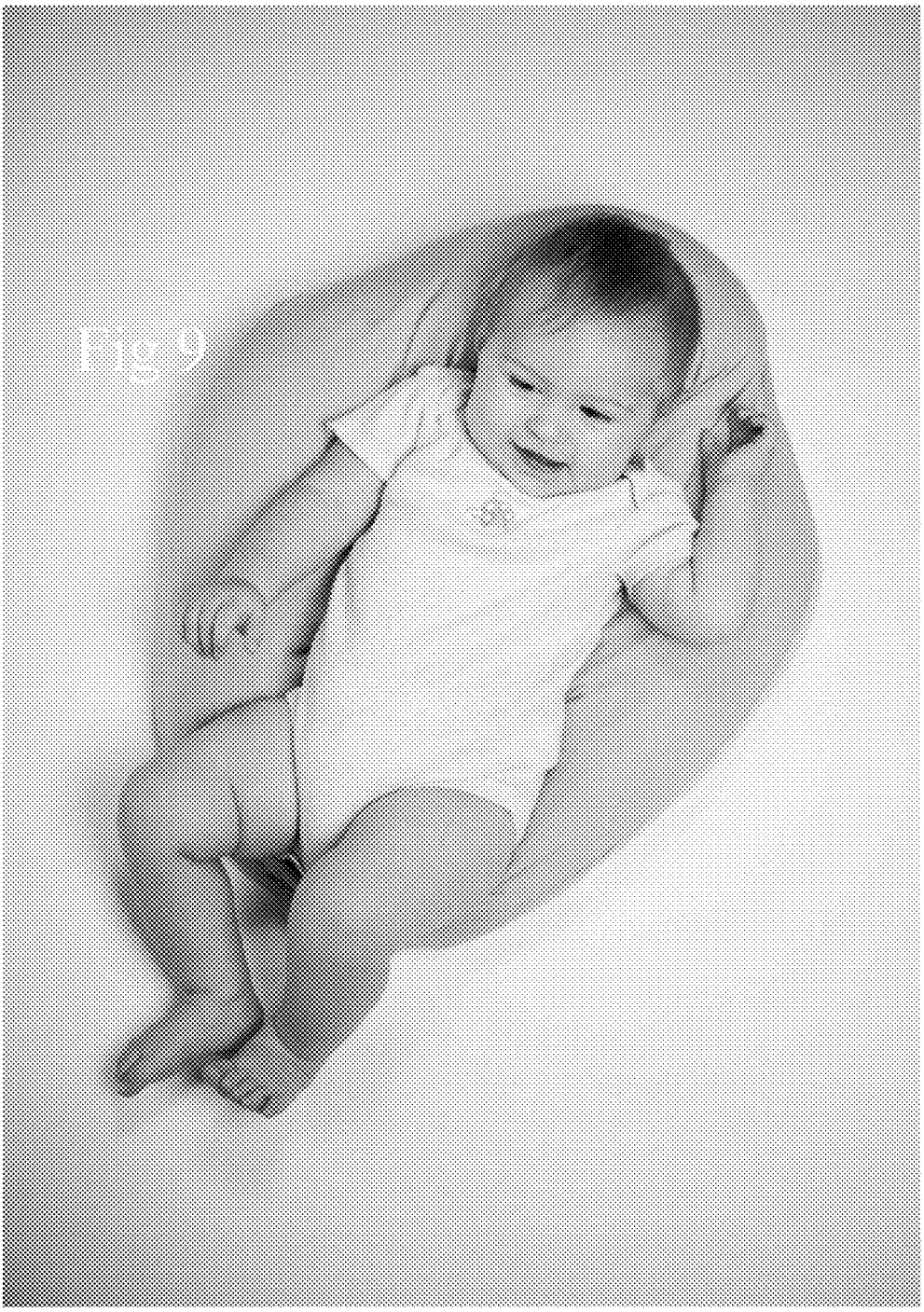
Figure 10:
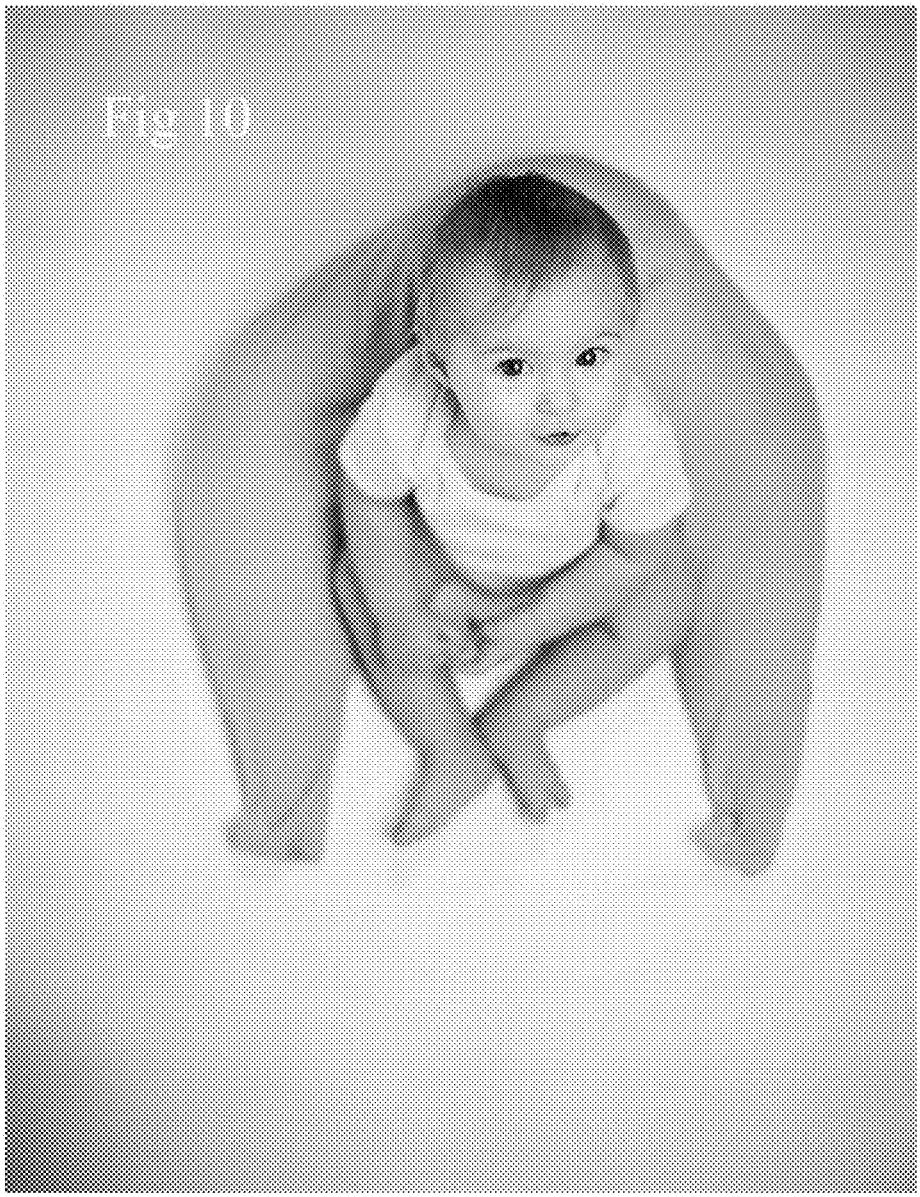
Figure 12:
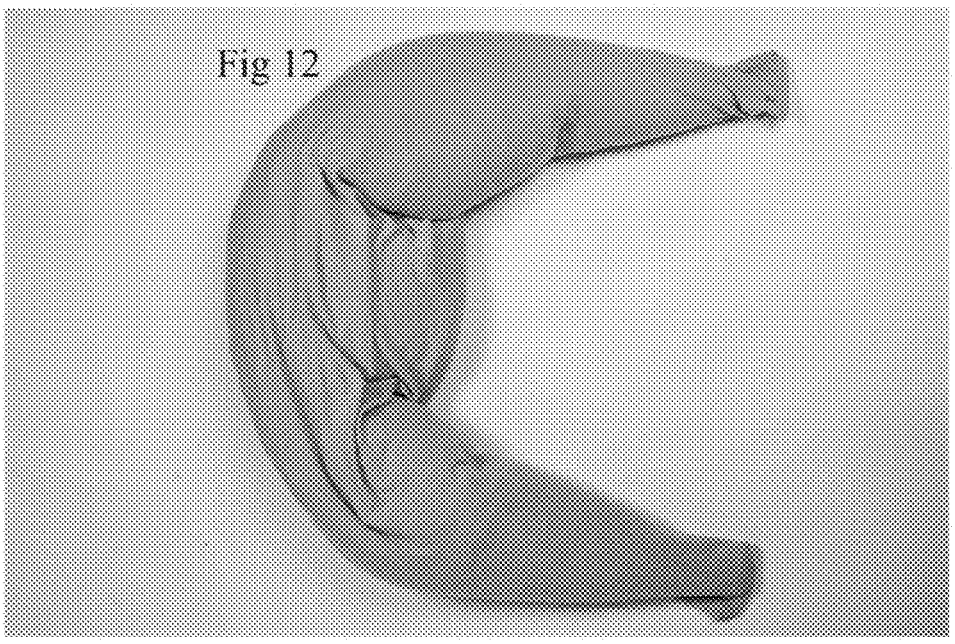
Figure 13:
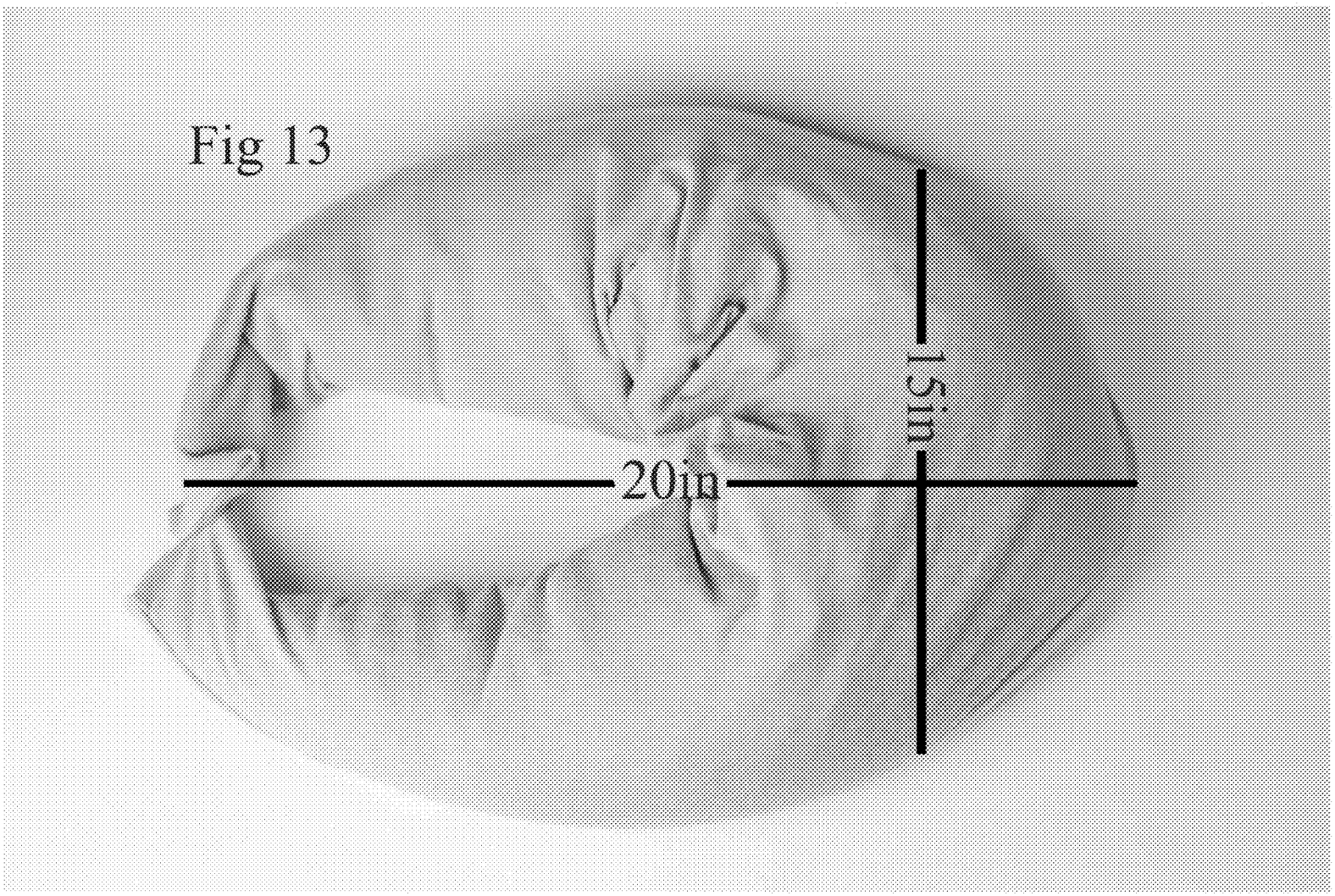
Figure 15:
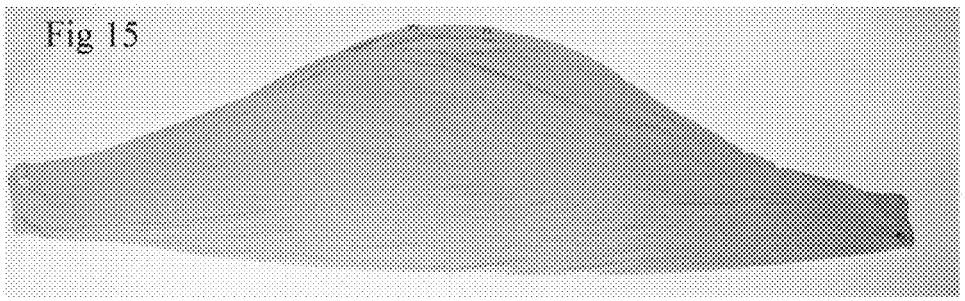
FIG. 15 Top view of outside case for the pillow with straight side measuring 48 in long FIG. 16 Top view of mother nursing on lower breast with pillow shaped in the unsnapped L shape position FIG. 17 Side view of baby sleeping in snapped oval position.
Figure 16:
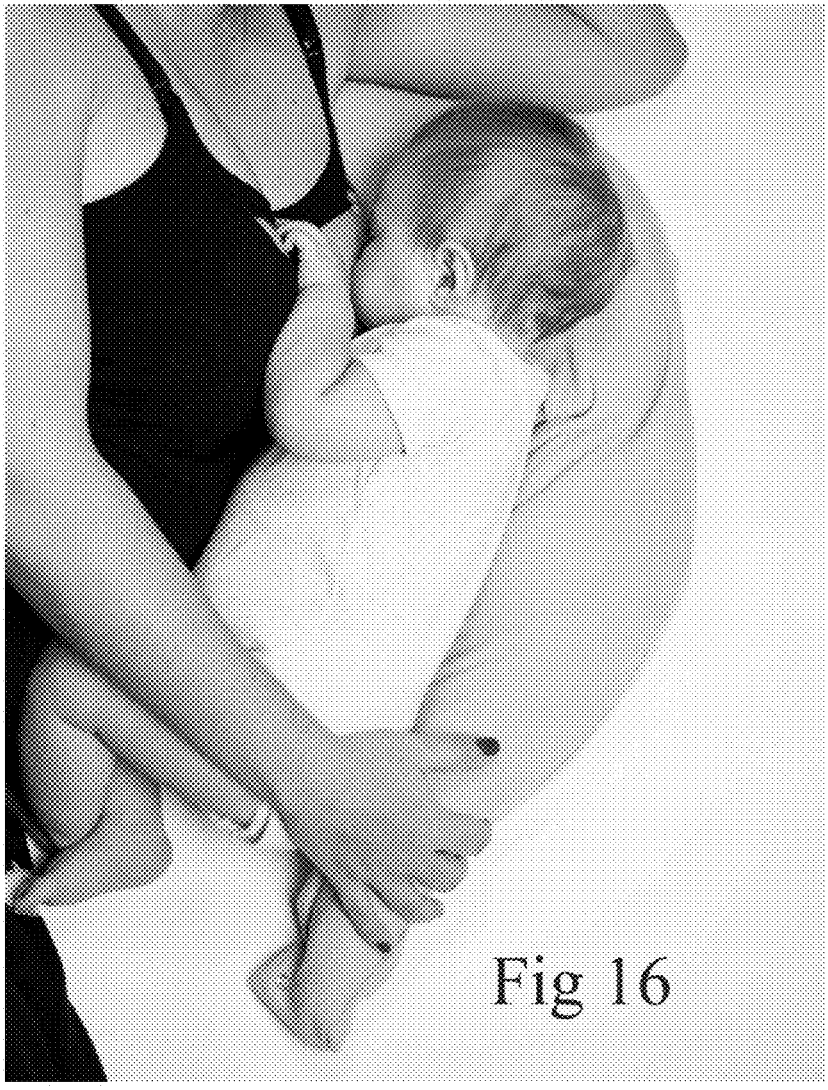
Figure 17:
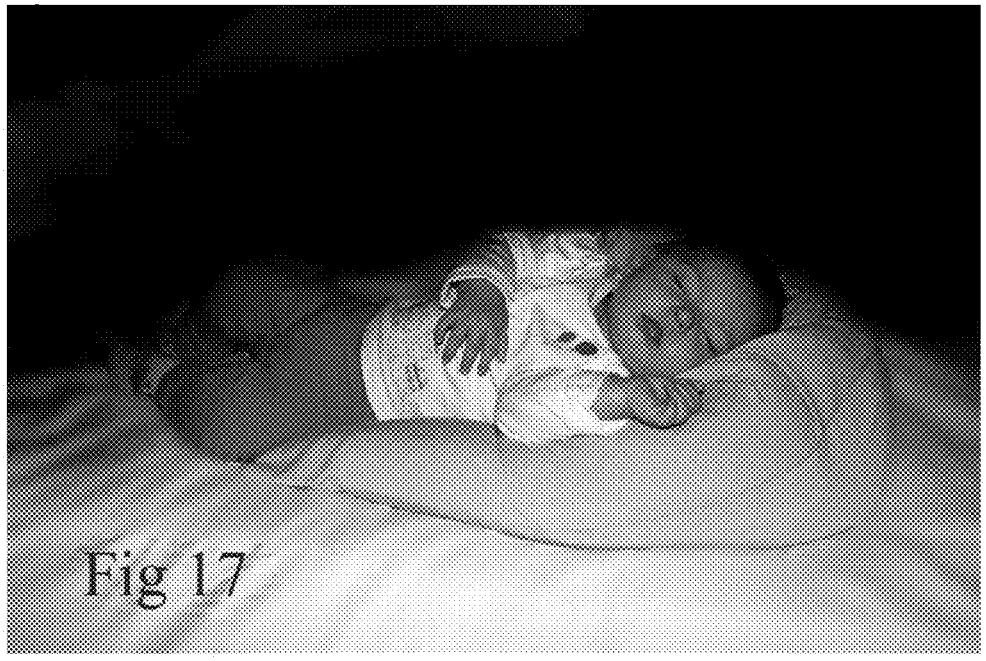
Figure 18:
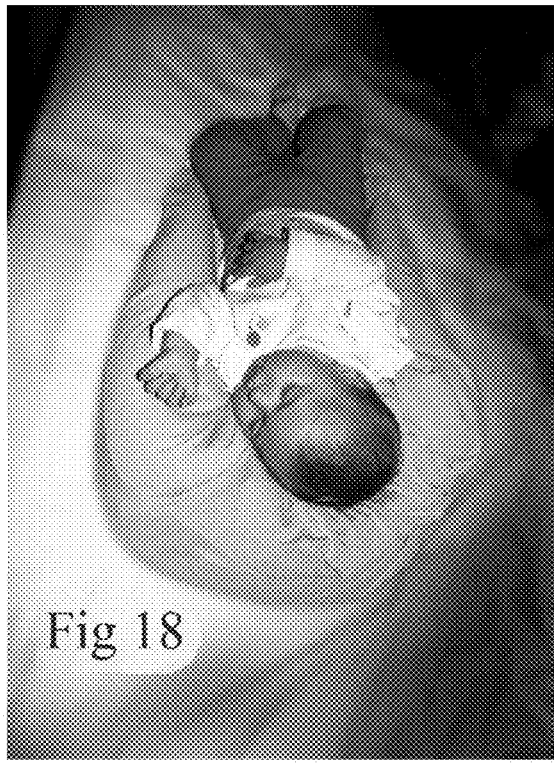
FIG. 18 Top Front view of baby sleeping in unsnapped U position.
Figure 19:
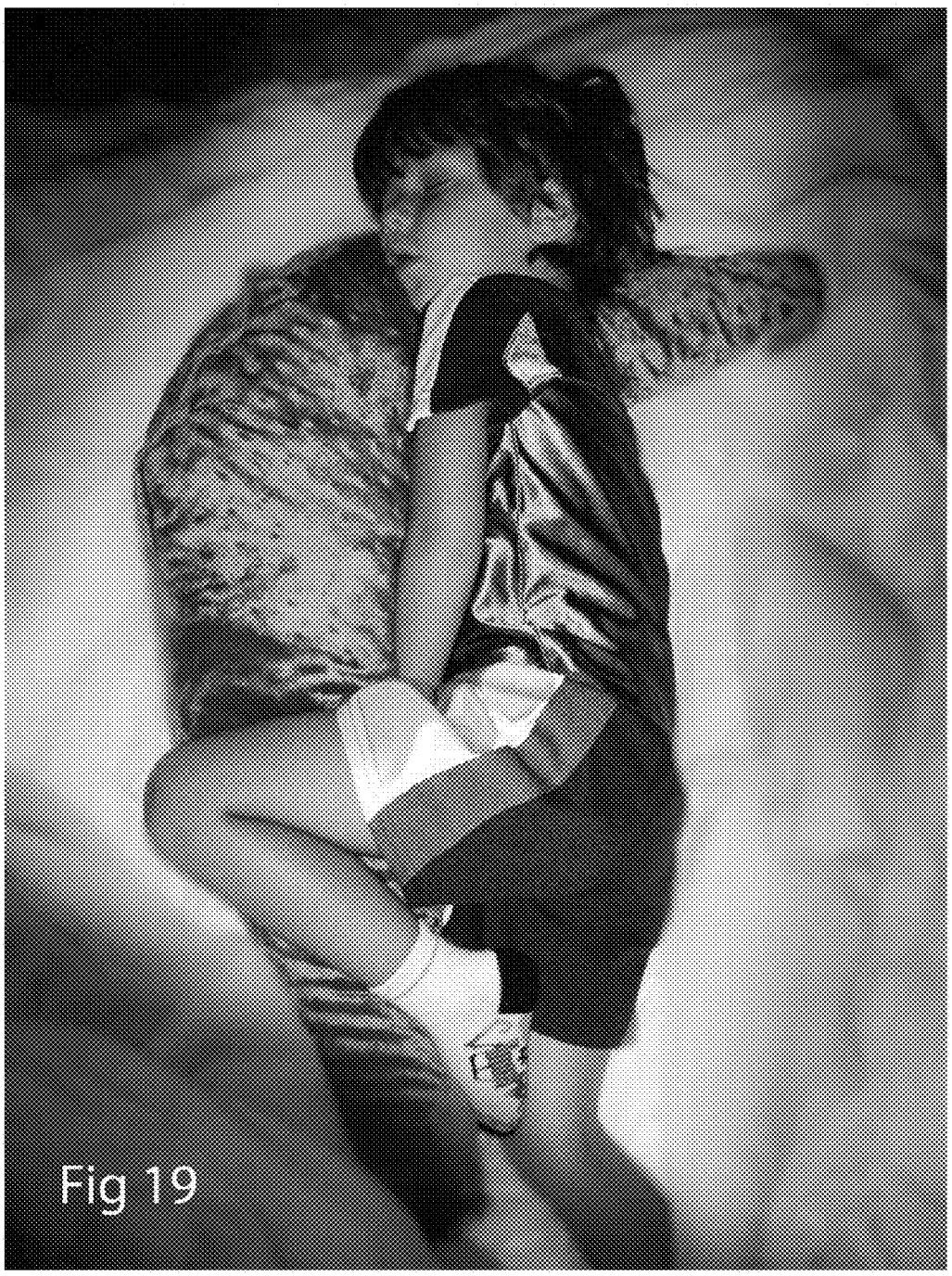
FIG. 19 Front view of toddler sleeping with pillow configured in L position.

The second part of the pillow is an easily removable and washable covering made from either bamboo fiber or another soft hypo-allergenic fabric. The pillow covering is fitted with two snaps that allow the pillow to be shaped into five different positions that are formed by snapping or unsnapping the ends of the pillow (FIG. 15). Snapped the pillow can be shaped into a round O shape (FIG. 1,) a cone shape (FIG. 2) or an oval shape (FIG. 13). Unsnapped the pillow forms into a horseshoe or U shape (FIG. 3, FIG. 12), and an L shape (FIG. 4, FIG. 19).

The invention claimed is:

1. A two part formable pillow comprising:

an inner part containing three sections, including a substantially rectangular center section with a triangular tapered arm on either side, and a buckwheat hulls filling;

wherein the inner part fits inside an outer part;

wherein the outer part comprises an outside cloth covering having a straight side measuring forty eight inches long and convex curved side opposite the straight side, and the covering having a maximum width between the straight side and the curved side of twelve inches to fourteen inches;

wherein a first end of the pillow can be connected to a second end of the pillow to configure the pillow in at least five positions; first to create an O-shape, second an oval shape, third a cone shape, fourth a U-shape, and fifth an L-shape.

2. A pillow as set forth in claim 1 wherein the inner part is removable and fits in to the outside cloth covering and the outside cloth covering being washable.

3. A pillow as set forth in claim 1 wherein in the fifth L-shape position a head of a child is adapted to rest on one of the tapered triangular arms measuring twenty inches and a child's torso and leg can rest on the remaining two portions of the pillow measuring twenty seven inches long.

4. A pillow as set forth in claim 1 wherein the first O-shape is created when first end is attached to the second end creating an O-shape for infant to lay within.

5. A pillow as set forth in claim 4 wherein the second oval shape position is created by adjusting the arms farther apart from the first O-shape position for larger infants to be cradled within.

6. A pillow as set forth in claim 4 wherein the third cone shape position is created by pushing the arms of the O-shape position into each other for a newborn to be positioned completely on top of the pillow.

7. A pillow as set forth in claim 1 that in the first O-shape, second oval shape, and third cone shape aids in nursing while laying down or reclining by supporting both a baby in the middle an adult's breast and an outer edge of either tapered triangular arm creating a ledge for the breast to rest on.

8. A pillow as set forth in claim 1 wherein the fifth L-shape is used when nursing while seated on a couch or in a recliner; such that an adult user places one of the triangular arms under their arm with narrowest part toward armpit and the other two parts of pillow on their lap for baby to rest on while nursing.

9. A pillow as set forth in claim 1 wherein when in the fourth U-shape position the substantial rectangular section can be configured around a baby's bottom and lumbar to help support the baby without limiting their reach or mobility when starting to sit up, or the substantial rectangular center section can be positioned around a baby's head and the arms cradle a baby's torso.

* * * * *